US005600360A

United States Patent [19]

Lerner et al.

[11] Patent Number: 5,600,360

[45] Date of Patent: Feb. 4, 1997

[54] THERMAL IMPRINTER AND METHOD

[75] Inventors: Bernard Lerner, Aurora; William M. Cronauer, Tallmage, both of Ohio

[73] Assignee: Automated Packaging Systems, Inc., Streetsboro, Ohio

[21] Appl. No.: 641,281

[22] Filed: Apr. 30, 1996

[51] Int. Cl.[6] ..... B41J 2/325

[52] U.S. Cl. ..... 347/171

[58] Field of Search ..... 400/231, 234, 400/120.01; 347/171, 215, 217

[56] References Cited

U.S. PATENT DOCUMENTS

| | | | |
|---|---|---|---|
| 4,420,268 | 12/1983 | Tsukamura et al. . | |
| 4,505,603 | 3/1985 | Yana . | |
| 4,548,024 | 10/1985 | Fine . | |
| 4,551,729 | 11/1985 | Kubo et al. . | |
| 4,653,939 | 3/1987 | Hibino . | |
| 4,659,416 | 4/1987 | Johansson . | |
| 4,788,558 | 11/1988 | Caldwell et al. . | |
| 5,017,028 | 5/1991 | Harding . | |
| 5,137,378 | 8/1992 | Satoh . | |
| 5,168,286 | 12/1992 | Okauchi et al. . | |
| 5,251,988 | 10/1993 | Frazier . | |
| 5,255,012 | 10/1993 | Amano . | |
| 5,265,966 | 11/1993 | Schmidt . | |
| 5,371,521 | 12/1994 | Wehrmann | 400/611 |
| 5,372,440 | 12/1994 | Slater . | |

FOREIGN PATENT DOCUMENTS

| | | |
|---|---|---|
| 0311981 | 4/1987 | European Pat. Off. . |

*Primary Examiner*—Huan H. Tran

*Attorney, Agent, or Firm*—Watts, Hoffmann, Fisher & Heinke Co., L.P.A.

[57] ABSTRACT

An imprinting mechanism has a frame delineating a printing station. A printing carriage including a printer is reciprocatably carried by the frame. A drive is interposed between the carriage and the station for causing selective relative movement between the carriage and the station in printing and return directions. Spaced web supply and take-up mechanisms delineate the ends of a printing web path of travel from the supply past the station and the carriage to the take-up. A web brake is provided which has an on position preventing relative web and carriage movement when the carriage and station relatively moved in the return direction and an off position permitting tape and carriage movement when the carriage and station are relatively moved in the printing direction and the printer is printing.

36 Claims, 4 Drawing Sheets

THERMAL IMPRINTER AND METHOD

This invention relates to imprinting machines and processes and more particularly to those machines and processes which utilize elongated webs each carrying an imprinting material which is, through energization of a printhead, heat transferred onto a workpiece.

BACKGROUND OF THE INVENTION

U.S. Pat. No. 5,371,521 entitled Packaging Machine with Thermal Imprinter and Method (the "Teeter-Totter" patent) issued Dec. 6, 1994 to Rick S. Wehrmann and assigned to Automated Packaging Systems, Inc., the assignee of this patent, illustrates one application for thermal imprinters. That application is a schematically shown packaging machine which utilizes elongated chains of interconnected, preopened bags which are sequentially fed to a load station. As a web of interconnected, preopened bags is fed along a path of travel from a supply to the load station, the web passes a printing station. A thermal imprinter located at the printing station is utilized to imprint individual bags with information relative to the products being packaged, such as part numbers and instructions for use.

Thermal imprinters of the type shown in the Teeter-Totter patent utilize elongate printing foils or webs. Such a web is fed from a supply spool along a web path of travel through a printing station to a take-up mechanism which takes up spent printing foil. With prior machines when a workpiece is positioned at the printing station, the workpiece and printing foil are relatively fixed together for a printing operation. A printhead is then scanned along the web and energized at appropriate times in appropriate configurations to thermally transfer printing material from the web to the workpiece. When a workpiece is to be imprinted at spaced locations the printhead performs a printing operation at a first location and then it is moved relative to the workpiece and the web to the second location before it performs the second and spaced printing of information. The foil between the two printed locations is wasted because following the imprinting fresh foil is fed from the supply as the take-up draws in foil until the foil spanning the length of the printing station is fresh and unused. Obviously, such a procedure is wasteful. The procedure also adds considerable unneeded cost because the printing foils are quite expensive.

The procedures used with prior thermal imprinters have a further problem in that in many instances by the time the printing operation is completed the thermally transferred printing material has cooled and hardened. Accordingly, prior machines have been equipped with knife mechanisms for separating the foil from the workpiece following the printing operation. Not only does this obviously add cost and complexity to thermal printers, but it also degrades the quality of the printing from a level which might otherwise be achieved because the separation may not effectively transfer all of the material intended to be transferred and may cause chipping and flaking of the transferred print material as well.

SUMMARY OF THE INVENTION

With the thermal imprinter of the present invention, printing web waste is, for the first time, minimized to near the maximum extent theoretically available. Relative motion of the printhead and a printing foil longitudinally of the web is confined to those occasions in which a printing operation is being performed.

When a machine embodying the present invention is operated, a workpiece is positioned at a printing station. The printing foil and printhead with its carriage are relatively fixed longitudinally and then moved together relative to the workpiece until the printhead is positioned at a location where the workpiece is to be imprinted. Once so positioned, the printing foil is fixed relative to the workpiece and the printhead scans the foil and workpiece as it thermally transfers the print media from the foil to the workpiece.

Once printing at a given location has been completed, the foil is again fixed relative to the printhead and the carriage. The workpiece and printhead are then relatively moved, while the foil and printhead are relatively fixed until the printhead and workpiece are relatively positioned at another to be printed location. The foil and printhead are now permitted to move relatively, while the foil is again fixed relative to the workpiece and a second printing operation is performed. Due to the unique limitation on relative movement between the printhead and foil, material transferred from the foil during the second printing operation is from a foil location immediately adjacent the location from which the material was transferred during the first printing operation.

In its preferred form a printer made in accordance with the present invention has a frame which delineates a printing station having a planar surface for supporting a workpiece. The frame has an upstanding section which supports a reciprocatable printing carriage. The carriage includes a mounting section which is reciprocatably supported on the frame and a printhead support section pivotally connected to the mounting section. The support section is movable between a printing position wherein it is parallel to and closely spaced from the printing station surface and an elevated access position. A printhead is mounted on the carriage support section and positioned, when the support section is in its printing position, to effect printing on a workpiece positioned on the station surface.

Web supply and take-up mechanisms are carried by the upstanding section. Printing foil is fed from the supply under a pair of carriage and upstanding section mounted idler rolls positioned on either side of the printhead, thence over a carriage mounted brake roll, around an upstanding section mounted brake roll and then to the take-up.

Alternately actuated brakes are operably connected to the brake rolls for selectively permitting and preventing relative carriage and foil movement. Tension is maintained on the web by oppositely rotatable drives respectively connected to the supply and take-up. These drives are constantly energized when the printing machine is in use as foil is wound onto and unwound from supply and take-up spools in a window shade like action.

The carriage mounted idler roll is downstream from the printhead and is mounted in spaced relationship with the workpiece support surface. Assuming the workpiece support surface is horizontal this downstream idler roll is spaced above the workpiece support such that as the carriage advances spent foil is pulled angularly upwardly away from the printing station.

Because the spent foil is pulled upwardly as the printhead advances in a printing operation a rather surprising result is achieved. The spent foil is separated from the workpiece virtually as soon as a given line of printing has been completed and the printhead advances to imprint the next line. Because the foil is separated from the workpiece a very short time after the printhead has effected its imprinting, the transferred media are still heat softened, such that the print media readily separate from the foil and the need for some special separating mechanism, such as a doctor knife, is totally eliminated. When the printhead completes its last line of printing prior to movement to another and spaced location on the same workpiece or return of the carriage to its start position, the printhead is elevated to allow the tensioned web to be stripped from the workpiece while the print material of the last line is still heat softened.

The printhead is maintained in its elevated position at all times other than when it is imprinting. Tension from either the supply or the take-up spool lifts the web into spaced relationship with the printing station when the printhead is elevated. Among other advantages this facilitates removal of a printed workpiece and positioning of a new workpiece in the printing station concurrently with the return of the printhead to its start position.

With a process performed in accordance with the present invention, the printhead support section of the carriage is pivoted to its access position. Any service required, such as cleaning the printhead, is then performed to ready the printer for operation. A supply spool of printing material is then mounted on the supply mechanism and a web is fed from the spool along its path of travel to the take-up mechanism. Next, in either order, a workpiece is positioned on a support and the printhead support section is pivoted to its printing position.

After the described setup procedures have been performed, the printhead and workpiece are then relatively moved longitudinally to align them at a location to be printed. The printhead is then pivoted to force the web into engagement with the workpiece. Once the web and workpiece are in engagement the printhead is energized. While the printhead is energized to imprint the workpiece, the web and the workpiece are held in fixed relative positions longitudinally. While there is no relative longitudinal movement of the web and workpiece, the printhead is slid along the web to bring only that part of the web from which media is transferred into engagement with the workpiece. When the printhead and workpiece are being moved relatively and the printhead is not energized, the foil is permitted to move longitudinally relative to the workpiece but is fixed relative to the printhead in a direction longitudinal of the web. Thus, longitudinal movement of the foil relative to the printhead occurs only when a line of imprinting has been completed and the two are being relatively moved longitudinally to continue printing to produce an additional line of print. The longitudinal relative movement of the printhead and the web is only a minimum amount necessary to register an unused section of web with the printhead.

The printhead of this invention is of the type in which the so called "dot row" is positioned along a corner of the printhead. This enables the printhead to be canted such that the lead surface, in the direction in which the printhead is advanced relative to a web as it is printing, is canted at an acute angle with the web. Thus, the tendency of printheads of prior machines to "dig into" the print web or foil is eliminated. Rather, the printhead is dragged along the foil enhancing the foil to workpiece contact where, but only where printing is occurring. This dragging also enhances the maintenance of the fixed longitudinal relationship of the web and workpiece in that it cams them together, rather than tending to dig into and therefore pull the web in the direction the printhead is traveling.

A section of the path of travel between the two brake rolls parallels the section of the path of travel of the carriage. As the printhead is imprinting a workpiece, foil is removed from the printed section of the path and added to the take-up section. Accordingly, the amount of foil added to the take-up section should equal the amount being removed from the printing section and the preferred and simplest means of achieving this equal removal and take-up is by having the two sections parallel one another.

Accordingly, the objects of the invention are to provide a novel and improved thermal imprinter and a process of utilizing such an imprinter.

In The Drawings

DETAILED DESCRIPTION OF PREFERRED EMBODIMENT

Figure 2:
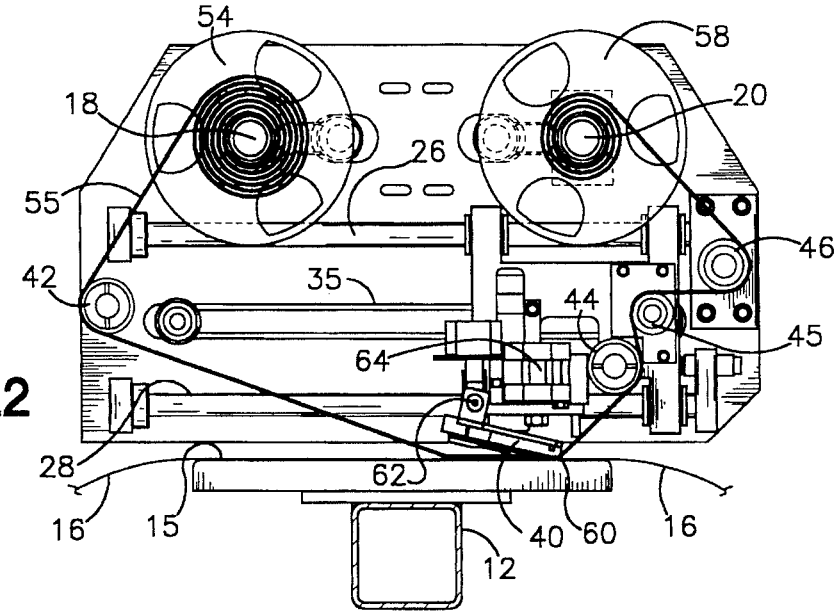
FIG. 2 is an elevational view of the thermal imprinter of FIG. 1 on a reduced scale and showing the carriage in a start position for a printing operation.
Figure 3:
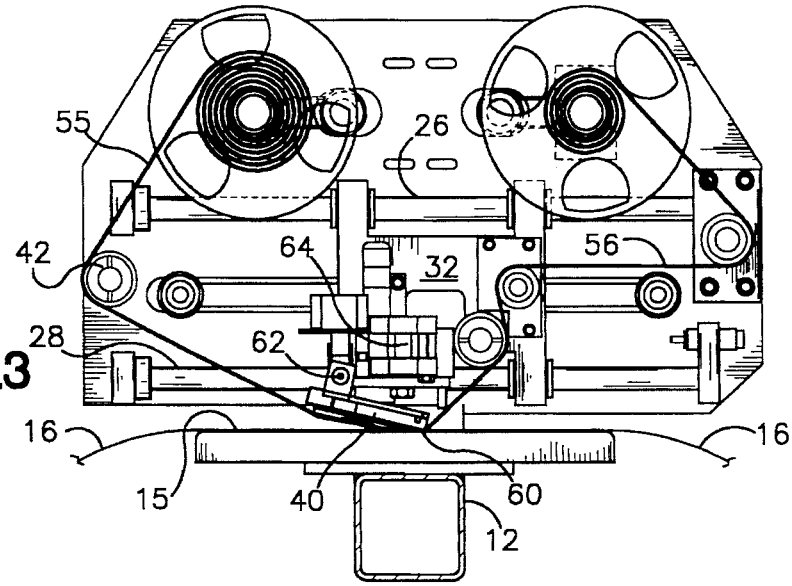
FIG. 3 is an elevational view corresponding to FIG. 2, but showing the carriage in an intermediate position in its travel.
Figure 4:
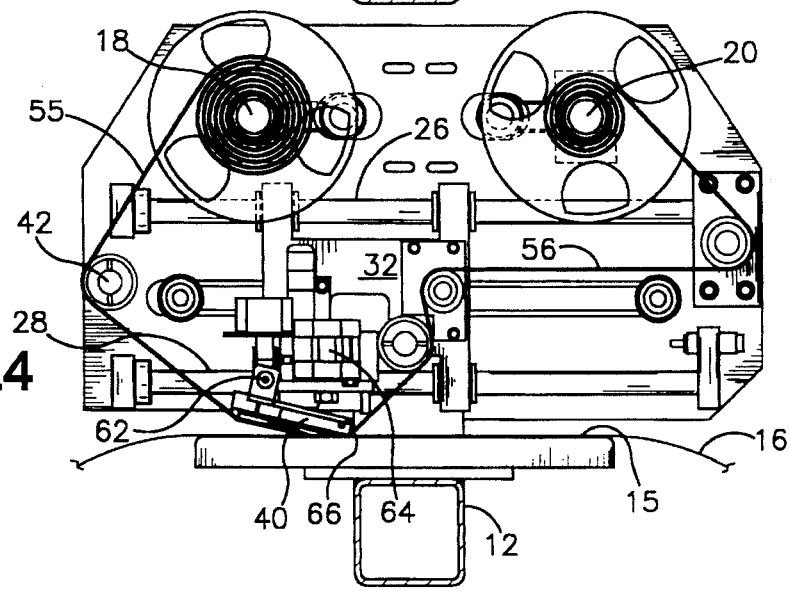
FIG. 4 is a view corresponding to FIGS. 2 and 3, showing the carriage near the conclusion of printing advance travel and the beginning of return travel for positioning the printhead for printing of a subsequent workpiece.

The printer of this invention is shown in each of the drawings. The printer includes a printer frame shown generally at 10. The printer frame 10 has a base section 12 and an upstanding section 14. The base 12 includes a planer surface 15 delineating a work station. When the printer is in operation, a workpiece 16, FIGS. 2–4, is supported on the surface 15.

Figure 5:
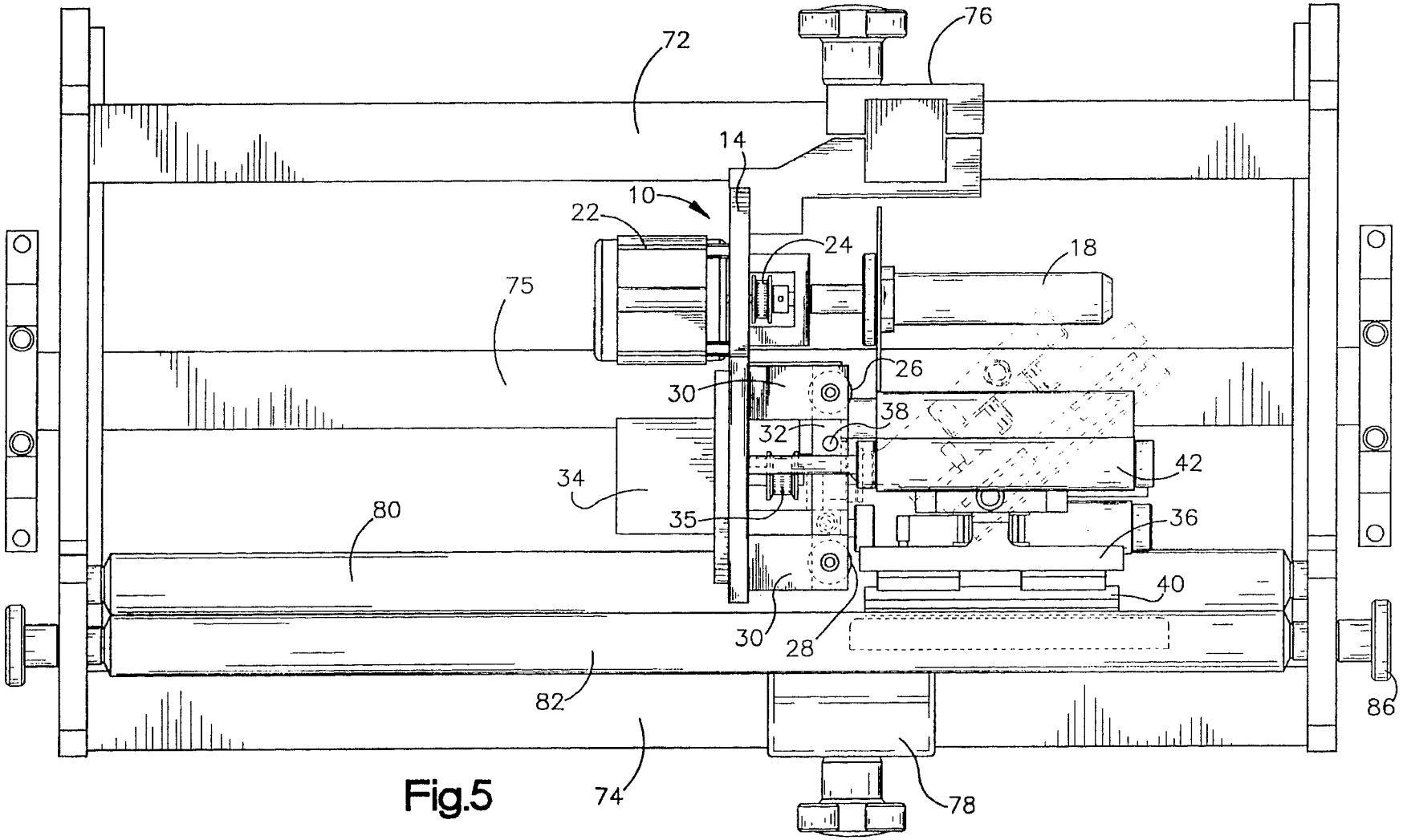
FIG. 5 is a side elevational view of the printer of this invention on an enlarged scale with respect to the other drawings and showing the printhead support section in its printing position in solid lines and its access position in phantom; and, FIG. 6 is a plan view of the thermal imprinter of this invention.
Figure 6:
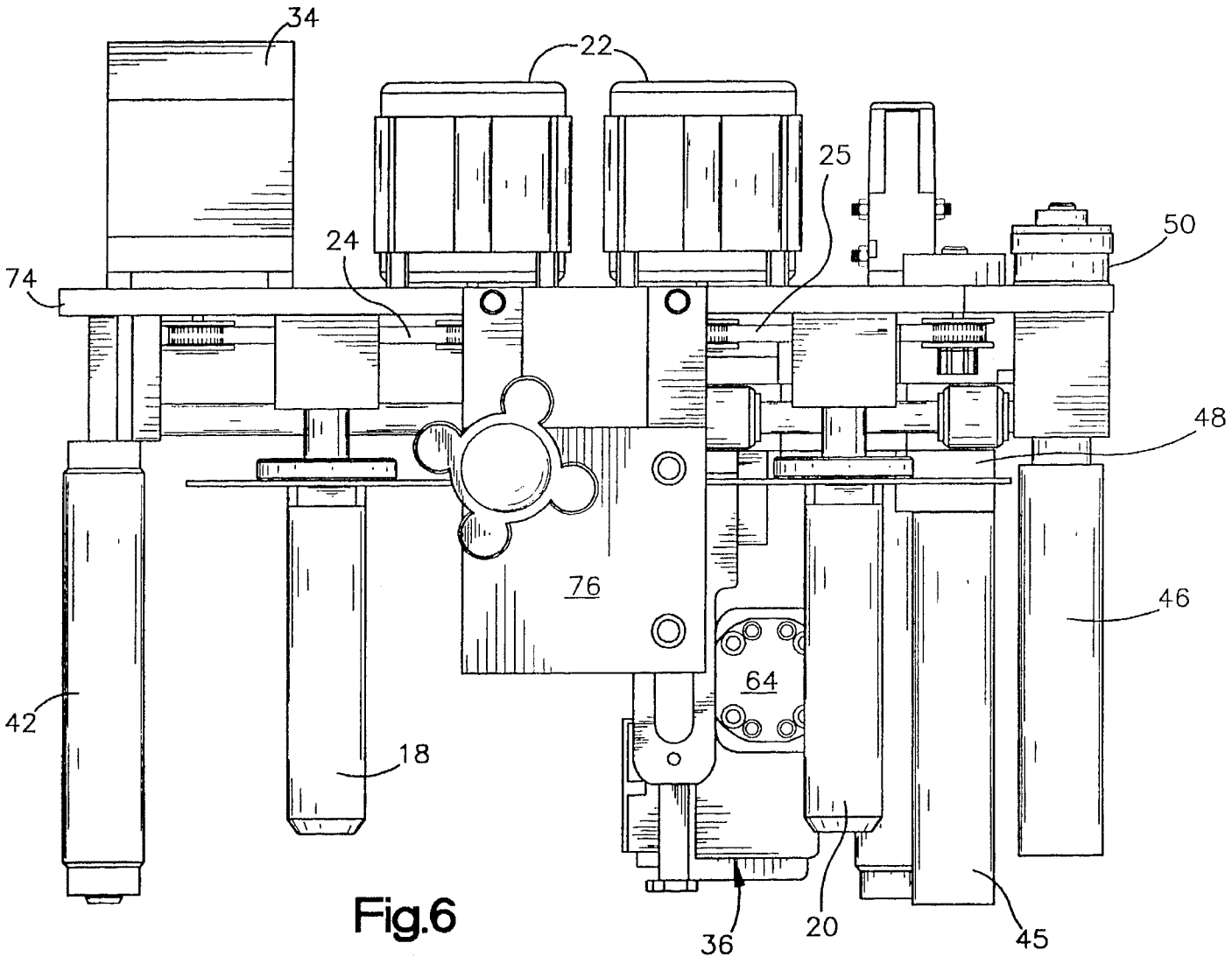

Web supply and take-up spool supports 18, 20 are supported by the upstanding section 14. A pair of oppositely driven web drive motors 22 are provided. One of the motors 22 is visible in each of FIGS. 5 and 6. The web drive motors are respectively coupled to the supply and take-up supports 18, 20 via supply belt 24, FIGS. 5 and 6, and a take-up belt 25, FIG. 1.

Upper and lower carriage support rods 26, 28 are supported on the upstanding frame section 14 by brackets 30. A printing carriage mounting section 32 is reciprocatably and slidably supported on the support rods 26, 28. A reversible carriage drive motor 34 is supported on the upstanding support section 14. The carriage motor 34 is connected to the carriage mounting section 32 via a belt 35 for shifting the carriage in its reciprocal movement from right to left and return as viewed in FIGS. 2–4.

Figure 1:
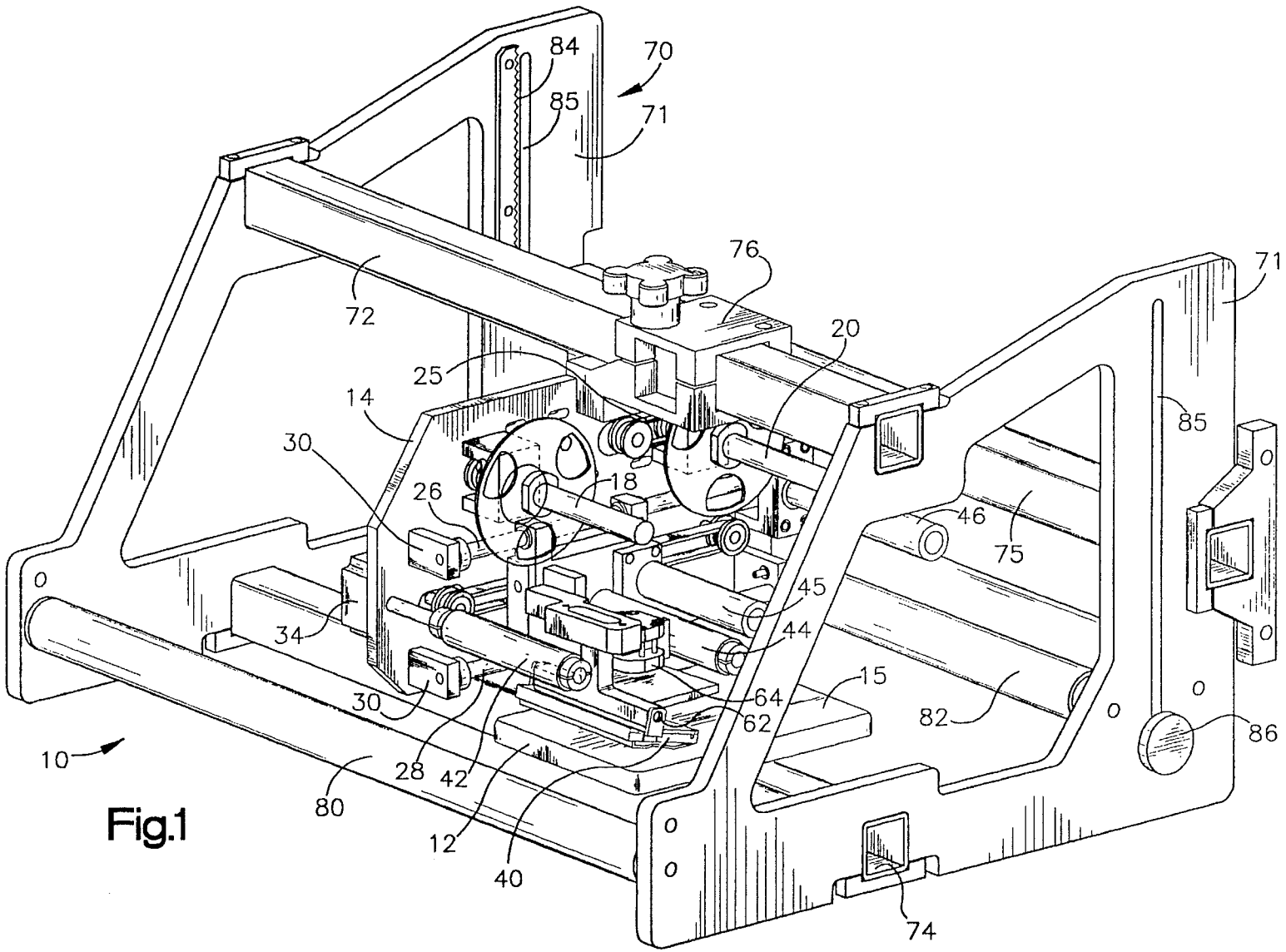
FIG. 1 is a perspective view of the thermal imprinter of this invention.

A carriage printhead support section 36, is connected to the carriage mounting section 32 by a pivot 38. The printhead support section 36 is pivotal between a printing position, FIGS. 2–5, and an elevated access position, shown in phantom. A printhead 40, FIG. 1, is carried by the printhead support section 36.

A pair of frame and carriage mounted idler rollers 42, 44 are respectively mounted on the frame upstanding section 14 and the carriage mounting section 32. Carriage and frame mounted brake idler rollers 45, 46 are respectfully mounted on the carriage mounting section 32 and the frame upstanding section 14. Alternatively energized brakes shown schematically at 48 and 50 are respectively operatively connected to the brake rolls 45, 46.

A web supply spool 54 is mounted on the web supply support 18. A web or foil 55 is fed along its path of travel. The path of travel is from the supply spool 54 around the frame mounted idler roll 42, under the printhead support section 36 and the printhead 40, around the carriage mounted idler roller 44 and thence around the brake idler roller 45, across a span 56, and around the brake roll 46 to a take-up spool 58.

The printhead 40 is of a type which has a dot row extending along a corner 60. The printhead is supported by a pivot 62. An air cylinder 64 is carried by the printhead support section 36 and actuatable to shift the printhead 40 about the pivot 62. The printhead 40 is movable between a storage position shown in FIGS. 1 and 5 and a printing position shown in FIGS. 2–4. As an examination of FIGS. 2–4 will show, the web 55 is urged into essentially line engagement with a workpiece 16 when the printhead is in its printing position. When the printhead is in its elevated or storage position, the constant tensioning of the supply 18 pulls the foil out of engagement with the workpiece 16 maintaining it wrapped under the printhead 40 in spaced relationship with the workpiece.

In FIG. 1 an arrangement for supporting one or more of the thus far described printers is shown. The arrangement includes a support frame shown generally at 70. The support frame 70 includes spaced side plates 71 maintained in spaced relationship by upper, lower and end cross members 72, 74, 75. In the disclosed and preferred arrangement the cross members are tubular elements of square cross section. Upper and lower, split, support clamps 76, 78 respectively mount the printer on the upper and lower cross members.

Input and output workpiece guide rolls 80, 82 are supported by the side plates 71. The guide rolls are positioned such that they will maintain an elongate workpiece web in sliding relationship with the work station surface 15. The output guide roll is vertically adjustable by coaction of a rack 84 and a pinion not shown. Vertical elongate slots 85 respectively formed in the side plates 71 permit this vertical adjustment when a clamp knob 86 is released.

OPERATION

In operation the printhead support section is moved to its elevated access position. Any service of the printhead 40 that is required is performed at this juncture. A workpiece in the form of an elongated chain of preopened bags is shown schematically at 16 in FIGS. 2–4. The workpiece is fed under the guide rolls 80, 82 and across the planar support surface 15 to position it in the printing station. The printhead support section 36 is moved to its printing position and the carriage is located in the position shown in FIG. 2.

As a printing operation commences the brake 50 of the frame mounted brake roll 46 is energized to prevent web movement relative to the workpiece. Concurrently the air cylinder 64 is energized to shift the printhead 40 to its printing position and bring the web 55 into engagement with the workpiece 16. The printhead is promptly energized to effect a thermal transfer of heat softenable print material from the web 55 onto the workpiece 16.

When a line of imprinting is completed, the carriage drive motor 34 indexes the printhead from right to left as viewed in FIGS. 2–4. Assuming the printing operation is continued, the frame mounted brake idler roll 46 remains locked.

Once a given section of printing is completed, if there is to be a further section of printing at a spaced location on the workpiece, several things happen. First the brake 48 of the carriage mounted brake roll 45 is energized to lock the roll 45 and prevent movement of the web 55 relative to the printhead. Second, the brake 50 of the frame mounted brake roll is turned off. Thirdly, the air cylinder 64 is deenergized to permit a return spring (not shown) to lift the printhead. Fourth, the carriage advances from right to left from the position of FIG. 2 to the position of FIG. 3, for example. As the carriage advances from the FIG. 2 to the FIG. 3 position, spent foil is pulled from the take-up spool 58 against the biasing of the take-up drive motor 22, while unused foil is rewound on the supply spool 54 as it is driven by the supply spool motor 22.

Assuming printing of a second segment commences at the position shown in FIG. 3, due to the described braking action and tensioning of the foil, there has been no longitudinal movement of the printhead relative to foil as the printhead moved from its FIG. 2 to its FIG. 3 position. Accordingly, any printing that commences at the FIG. 3 position will be utilizing unused foil material immediately adjacent that utilized during imprinting operation at the FIG. 2 position.

When printing is to commence at the FIG. 3 position, the air cylinder 64 lowers the printhead to its printing position and the brake roll brakes are again reversed. Thus, the carriage mounted brake roll 45 is free to rotate as printing is performed and the frame mounted brake roll 46 is locked to prevent foil movement relative to the workpiece. Here again, the foil upstream from the locked one of the idler brake rolls is tensioned by the constant operation of the supply spool motor rotating against the web.

Assuming a printing operation is performed as the carriage is moved from its FIG. 3 position to its FIG. 4 position, the length of foil along the take-up section 56 of the foil path of travel between the brake idler rolls is increasing. Concurrently, the length of a supply section of the path between the supply and the carriage mounted brake idler roll 44 is decreasing. The amount of decrease is equal to the amount of travel of the printhead, right to left as viewed in FIGS. 2–5. Accordingly, the amount of increase in the section 56 must be equal to the supply section decrease. Preferably to achieve this equal amount of increase, the web section 56 parallels the planar surface 15 as shown.

Once the carriage has reached its position of FIG. 4 and it is desired to return the carriage to its start position of FIG. 2, the air cylinder 64 is again deenergized and the printhead is lifted. The brake 48 of the carriage mounted brake roll 45 is again turned on, while the brake 50 of the frame mounted brake roll 46 is de-energized. Thus, under all conditions, one of the brakes for the brake rolls 45, 46 is energized and the other is not, with the energization alternating according to which portion of the printing cycle is occurring.

As the carriage returns to its FIG. 2 position, the take-up roll 58 winds in spent printing foil, while a fresh amount of foil 55 is fed from the supply. Thus, the supply and take-up spools function very much like window blinds as they are constantly tensioning the web 55, sometimes winding in and at other times paying out, the web. In short, the amount of foil feed is in fact controlled, not by the motors 22, but by reciprocation of the carriage at times when the printhead is not printing. When the printhead is printing, both the supply and take-up spools are stationary, as are the foil 55 and the workpiece 16.

As an examination of FIGS. 2–4 will show, the configuration of the printer is such that only a small segment of the foil 55 under the printhead 40 is actually juxtaposed against the workpiece 16 at any given time. Thus, as the carriage advances right to left, spent web material is pulled upwardly from the workpiece very shortly after the print material has been thermally transferred onto the workpiece. Because the thermal transfer has occurred only recently, it is still heat softened and separates readily from the workpiece. As a consequence, no special mechanism, such as a doctor knife, is required for separating the foil from the workpiece, as has been the case with most, if not all, prior printers.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

We claim:

1. An imprinting mechanism comprising:

a) frame structure delineating a printing station;

b) a printer positionable adjacent the station, the printer being carried by the structure;

c) a drive mechanism interposed between and operably connected to the printer and the station for causing selective relative movement between the printer and the station;

d) spaced printing web supply and take-up mechanisms delineating the ends of a printing web path of travel extending from the supply mechanism, past the station and the printer to the take-up mechanism;

e) a web brake operably connectable to a web and positioned along the path; and, f) the brake having an on position preventing relative web and printer movement when the printer and station are relatively moved and the printer is not operating, the brake having an off position permitting relative web and printer movement when the printer is printing.

2. The mechanism of claim 1 wherein at least one of the supply and takeup mechanisms constantly bias as a web in the path when the printer and station are relatively moved.

3. The mechanism of claim 1 wherein there is a second web brake having on and off positions and wherein the second brake is in its on position when the first mentioned brake is in its off position and visa versa.

4. The mechanism of claim 1 wherein the printer is reciprocatably mounted on the frame structure and relative motion of the printer and station is accomplished by reciprocating the printer.

5. An imprinting mechanism comprising:

a) frame structure delineating a printing station;

b) a printing carriage including a printer, the carriage being carried by the structure;

c) a drive mechanism interposed between and operably connected to the carriage and the station for causing selective relative movement between the carriage and the station in printing and return directions;

d) spaced web supply and take-up mechanisms delineating the ends of a printing web path of travel extending from the supply mechanism, past the station and the carriage to the take-up mechanism;

e) a web brake operably connectable to a web positioned along the path; and, f) the brake having an on position preventing relative web and carriage movement when the carriage and station are relatively moved in the return direction and an off position permitting relative web and carriage movement when the carriage and station are relatively moved in the printing direction and the printer is printing.

6. The mechanism of claim 5 wherein the brake is in its on position when the carriage and station are relatively moved in the printing direction and the printer is not printing.

7. The mechanism of claim 5 wherein there is a second web brake having on and off positions and wherein the second brake is in its on position when the first mentioned brake is in its off position and visa versa.

8. The mechanism of claim 5 wherein the carriage is reciprocatably mounted on the frame structure and relative motion of the carriage and station is accomplished by reciprocating the carriage.

9. The mechanism of claim 5 including a roll mounted on the carriage and positioned along the path and the brake is operably connected to the roll thereby being operably connectable to the web.

10. The mechanism of claim 5 wherein the printer has a corner adjacent the web path of travel for engagement with a web and causing thermal transfer of printing material to a substrate when it is effecting printing and wherein a dot row for effecting the printing is positioned near the corner.

11. The mechanism of claim 10 wherein the printer has surfaces adjacent the corner and the surface which is a lead surface when the printer is advancing relative to such web is at an acute angle relative to the path in the direction of its advance.

12. A printing machine of the type in which printing is accomplished by heat induced transfer of print material from an elongate web to an item to be printed comprising:

a) a frame having a base delineating a planer printing station for support of work pieces to be printed;

b) the frame also including an upstanding section;

c) a printing carriage reciprocatably mounted on the section;

d) a printhead mounted on the carriage and positioned to imprint work pieces located in the station;

e) supply and take-up spool supports carried by the section respectively for receiving web supply and take-up spools;

f) a pair of brake idler rolls respectively carried by the section and the carriage;

g) the carriage, the station and the brake idler rolls together delineating at least parts of a web path of travel from a supply spool on the supply support to a take-up spool on the take-up support;

h) a pair of rotatable web drives respectively operatively connected to the supports; and, i) a pair of alternately operated brakes respectively operatively coupled to the brake idler rolls for controlling web feed along the path.

13. The mechanism of claim 12 wherein there is a carriage drive operatively interposed between the section and the carriage.

14. The mechanism of claim 12 wherein the carriage mounting includes a pair of parallel guides.

15. A process of imprinting a substrate by transfer of indicia producing material from an elongate printing web bearing such material to a substrate comprising:

a) positioning the substrate in a printing station;

b) positioning a printhead near the station with a section of the web interposed therebetween;

c) relatively moving the printhead and the substrate while maintaining the web therebetween;

d) periodically energizing the printhead as the printhead and substrate are relatively moved to imprint the substrate;

e) while the printhead is energized to imprint the substrate, fixing the web relative to the substrate while permitting relative movement of the printhead and the substrate; and, f) longitudinally fixing the web relative to the printhead when the printhead and substrate are relatively moving and the printhead is not energized to perform a printing operation.

16. The process of claim 15 including the step of moving the printhead and web into juxtaposed relationship with the substrate when the printhead is printing and spacing the printhead from the substrate at other times.

17. The process of claim 16 wherein the printhead is supported by a carriage and the relative longitudinal movement of the printhead and the substrate is produced by reciprocally moving the carriage on the support.

18. The process of claim 15 wherein the printhead has a lead surface and including the further step of positioning the surface at an acute angle with respect to the web in the direction of relative printhead movement.

19. The process of claim 18 including the step of moving the printhead and web into juxtaposed relationship with the substrate when the printhead is printing and spacing the printhead from the substrate at other times.

20. The process of claim 15 further including the step of stripping the web from the substrate as the printhead and substrate are relatively moved and thereby separating the web from print material transferred to the substrate while the material is still heat softened.

21. The process of claim 20 wherein the stripping is caused at least in part by applying tension with a web supply mechanism.

22. The process of claim 15 wherein there is a supply spool of unused web and a take-up spool for taking up used web and wherein the spools are each constantly driven when a substrate is imprinted.

23. The process of claim 22 wherein the step of fixing the web against relative web and substrate movement also prevents used web take-up by the take-up spool.

24. A printing machine of the type in which printing is accomplished by heat induced transfer of print material from an elongate web to an item to be printed comprising:

a) a frame having a base delineating a planer printing station for support of work pieces to be printed;

b) the frame also including an upstanding section;

c) a printing carriage reciprocatably mounted on the section;

d) a printhead mounted on the carriage and positionable to imprint work pieces located in the station;

e) supply and take-up spool supports carried by the section respectively for receiving web supply and take-up spools;

f) a pair of brake idler rolls, one being carried by the section and the other being carried by the carriage;

g) a further pair of idler rolls at least one of which is carried by the carriage;

h) the carriage, the station and the idler rolls together delineating at least parts of a web path of travel from a supply spool on the supply support to a take-up spool on the take-up support;

i) a pair of web drives for oppositely tensioning such web, the web drives being respectively operatively connected to the supports;

j) a pair of alternately operated brakes respectively operatively coupled to the brake idler rolls for controlling web feed along the path;

k) the brake which is operably coupled to said one brake idler roll being operative to prevent rotation of said one brake roll whenever the printhead is functioning to imprint a workpiece; and, i) the brake which is operatively coupled to said other brake idler roll being operative to prevent rotation of said other brake idler roll at times when the printer is not functioning to imprint a workpiece.

25. The mechanism of claim 24 wherein there is a carriage drive operatively interposed between the section and the carriage.

26. The mechanism of claim 25 wherein the carriage drive is a motor mounted on the section and a belt is interconnected between the motor and the carriage for moving the carriage in response to operation of the motor.

27. A printing machine of the type in which printing is accomplished by heat induced transfer of print material from an elongate web to an item to be printed comprising:

a) a frame delineating a planer station for support of work pieces to be printed;

b) a printing carriage reciprocatably mounted on the frame;

c) a printhead mounted on the carriage and positionable to imprint work pieces located in the station;

d) supply and take-up spool supports carried by the frame respectively for receiving web supply and take-up spools;

e) a pair of idler rolls respectively carried by the frame and the carriage;

the carriage, the station and the idler rolls together delineating at least parts of a web path of travel from a supply spool on the supply support to a take-up spool on the take-up support;

g) a pair of rotatable web drives respectively operatively connected to the supports; and, h) a pair of alternately operated brakes respectively operatively connectably coupled to the web for selectively preventing and permitting relative web and printhead movement longitudinally the path.

28. The mechanism of claim 27 wherein there is a carriage drive operatively interposed between the frame and the carriage.

29. The mechanism of claim 27 wherein the carriage mounting on the frame includes a pair of parallel guides.

30. A process of imprinting a workpiece with a printing web having a layer of thermally transferable printing material comprising:

a) positioning a workpiece at a printing station;

b) causing thermal transfer of printing material onto the workpiece by energizing a printhead as the printhead engages the web and the web engages the workpiece, the thermal transfer thereby effecting printing of the workpiece;

c) as each line of printing is completed indexing the printhead longitudinally relative to the web and workpiece to move the printhead from registration with a used portion of the web from which material has been transferred to registration of the printhead with an unused portion of the web; and, d) stripping the used portion of the web from the workpiece while the thermally transferred material is warmer than the ambient whereby the use of a doctor knife or the like for stripping is avoided.

31. The process of claim 30 wherein steps (b) and (c) are alternately repeated to produce a series of lines of printing and the stripping step is repeated as to each line following completion of that line and while the temperature of each such line is elevated.

32. The process of claim 30 further including the step of moving the printhead away from the web following the imprinting of the last line whereby to enable the performance of the web stripping step from such last line.

33. A process of imprinting a workpiece by thermally transferring print material from a web comprising:

a) feeding a web portion along a path of travel from a supply past a printhead to a take-up;

b) positioning a workpiece in a printing station;

c) moving the printhead and the web together to register them at a workpiece printing start position;

d) longitudinally fixing the web and workpiece relatively and while the web and workpiece are so fixed energizing the printhead to effect imprinting of the workpiece by thermal transfer of such material; and, e) as steps (c) and (d) are performed tensioning said web portion with the supply and the take-up by applying opposed forces.

34. The process of claim 33 wherein the opposed forces are supplied by constantly driven rotatable supply and take-up motors.

35. The process of claim 31 further including the step of stripping the web from the workpiece as the printhead and workpiece are relatively moved and thereby separating the web from print material transferred to the workpiece while the material is still heat softened.

36. The process of claim 35 wherein the stripping is caused at least in part by applying tension with a web supply mechanism.

* * * * *